US011779103B2

(12) United States Patent
Spitaletta

(10) Patent No.: US 11,779,103 B2
(45) Date of Patent: Oct. 10, 2023

(54) CLEANER DISPENSING TOILET BOWL BRUSH AND HOLDER

(71) Applicant: Charles Spitaletta, Mahwah, NJ (US)

(72) Inventor: Charles Spitaletta, Mahwah, NJ (US)

(73) Assignee: Charles Spitaletta, Mahwah, NJ (US)

( * ) Notice: Subject to any disclaimer, the term of this patent is extended or adjusted under 35 U.S.C. 154(b) by 0 days.

(21) Appl. No.: 17/871,250

(22) Filed: Jul. 22, 2022

(65) Prior Publication Data

US 2023/0125623 A1 Apr. 27, 2023

Related U.S. Application Data

(63) Continuation of application No. 16/612,979, filed as application No. PCT/US2018/033628 on May 21, 2018, now Pat. No. 11,425,993.

(60) Provisional application No. 62/511,089, filed on May 25, 2017.

(51) Int. Cl.
*A46B 17/02* (2006.01)
*A46B 11/00* (2006.01)
(Continued)

(52) U.S. Cl.
CPC ..... *A46B 11/0065* (2013.01); *A46B 5/0095* (2013.01); *A46B 7/042* (2013.01);
(Continued)

(58) Field of Classification Search
CPC ..... A46B 5/00; A46B 11/00; A46B 11/0003; A46B 5/0095; A46B 5/02; A46B 17/02;
(Continued)

(56) References Cited

U.S. PATENT DOCUMENTS 4,852,747 A 8/1989 Breveglieri
5,687,856 A 11/1997 Kendrena
(Continued)

FOREIGN PATENT DOCUMENTS

CN 202168803 U 3/2012
CN 107713929 A 2/2018
(Continued)

OTHER PUBLICATIONS

VOTRON Mop broom holder organizer wall mounted garage storage rack tool hanger 5 position with 6 hooks holds up to 11 tools for home kitchen garden garage; URL: https://www.garagestoragecenter.org/votron-mop-broom-holder-organizer-wall-mounted-garage-storage-rack/ ; Accessed: Jun. 25, 2018.
(Continued)

*Primary Examiner* — Shay Karls
(74) *Attorney, Agent, or Firm* — Dinsmore & Shohl LLP

(57) ABSTRACT

A toilet brush assembly including a brush, including: a handle assembly including a handle assembly proximal end and a handle assembly distal end; and a brush head that includes a plurality of tufts of bristles disposed on an outer surface of the brush head, a cavity defined by an inner surface of the brush head, and a fastener portion. The toilet brush assembly also includes a base, including a cup for receiving the brush head. The brush head selectively couples to the handle assembly distal end at the fastener portion of the brush head at a handle assembly-brush head connection; and at least one of the base and the brush head define at least one interference feature formed from a surface of the base and that contacts the tufts of bristles when the brush head is in a rest position within the cup.

17 Claims, 7 Drawing Sheets

(51) Int. Cl.

| | |
|---|---|
| ***A46B 5/00*** | (2006.01) |
| ***A46B 7/04*** | (2006.01) |
| ***A46B 9/02*** | (2006.01) |
| ***A46B 17/08*** | (2006.01) |
| ***A46D 3/00*** | (2006.01) |
| ***A47K 11/10*** | (2006.01) |
| ***B25G 3/30*** | (2006.01) |
| *B25G 3/18* | (2006.01) |

(52) U.S. Cl.
CPC ..... *A46B 7/044* (2013.01); *A46B 9/025* (2013.01); *A46B 11/0062* (2013.01); *A46B 17/02* (2013.01); *A46B 17/08* (2013.01); *A46D 3/00* (2013.01); *A47K 11/10* (2013.01); *B25G 3/30* (2013.01); *A46B 2200/304* (2013.01); *B25G 3/18* (2013.01)

(58) Field of Classification Search
CPC ..... A47L 13/10; A47L 13/16; A46K 11/10; B08B 1/00; B08B 13/00; B25G 1/00
See application file for complete search history.

(56) References Cited

U.S. PATENT DOCUMENTS

| | | | | |
|---|---|---|---|---|
| 5,888,002 | A | 3/1999 | Fenstersheib | |
| 5,945,076 | A | 8/1999 | Leonard et al. | |
| 6,851,881 | B2 | 2/2005 | Slaboden | |
| 7,316,046 | B2 | 1/2008 | Michaels et al. | |
| 7,386,913 | B2 | 6/2008 | Jackson | |
| 7,530,138 | B1 | 5/2009 | Platt | |
| 7,861,859 | B2 * | 1/2011 | Reynolds | A47K 17/00 206/349 |
| 8,342,321 | B2 | 1/2013 | McAllan | |
| 9,801,520 | B2 | 10/2017 | Reyes | |
| 9,980,553 | B2 | 5/2018 | Balz et al. | |
| 2005/0158116 | A1 | 7/2005 | Belansky et al. | |
| 2009/0152132 | A1 * | 6/2009 | Wang | A47K 11/10 206/15.3 |
| 2017/0224097 | A1 * | 8/2017 | Reichmuth | A46B 11/0041 |

FOREIGN PATENT DOCUMENTS

| | | | | |
|---|---|---|---|---|
| CN | 207055454 | U | 3/2018 | |
| EP | 0005685 | A1 | 11/1979 | |
| WO | WO-0160200 | A1 * | 8/2001 | A46B 17/02 |

OTHER PUBLICATIONS

Hang-up 5-bracket organizer; URL: https://ungerconsumer.com/product/hang-up-5-bracket-organizer/ ; Accessed: Jun. 25, 2018.
International Search Report and Written Opinion dated Aug. 23, 2018 in related International Application No. PCT/US2018/033628.

* cited by examiner

CLEANER DISPENSING TOILET BOWL BRUSH AND HOLDER

CROSS-REFERENCE TO RELATED APPLICATION

This application claims priority to U.S. Non-provisional patent application Ser. No. 16/612,979 filed Nov. 12, 2019, entitled CLEANER DISPENSING TOILET BOWL BRUSH AND HOLDER, the contents of which are hereby incorporated by reference in its entirety.

TECHNICAL FIELD

The present disclosure relates generally to a toilet bowl brush, and more particularly to a toilet bowl brush with assembly features for improved cleaning and use.

BACKGROUND

Toilet bowl brushes are used in bathrooms and other places to clean toilets. Brushes need replacing after time and it is common that the entire bowl brush with a holder base is replaced when the only part that is unsanitary or in need of replacement is a head of the brush. Additionally, holder bases do not include features that make the replacement of the brush head simpler, such as features that may help separate the brush head from the brush because brush heads do not separate from brush bodies and because the brush assembly and base are disposed of together. It is also common for cleaner to be used with a bowl brush but not dispensed from one.

SUMMARY

According to one aspect of the present disclosure, a brush assembly includes a brush including a handle assembly, a brush head, and a base for receiving the head. The handle assembly includes a handle assembly proximal end and a handle assembly distal end. The brush head includes a plurality of tufts of bristles disposed on an outer surface of the brush head, a cavity defined by an inner surface of the brush head, and a fastener portion. The base includes a cup. The brush head selectively couples to the handle assembly distal end at the fastener portion of the brush head at a handle assembly-brush head connection. At least one of the base and the brush head define at least one interference feature formed from a surface of the base and that contacts the tufts of bristles when the brush head is in a rest position within the cup.

According to another aspect of the disclosure, a brush assembly or toilet bowl brush includes a handle assembly, and a brush head. The handle assembly includes a handle assembly proximal end and a handle assembly distal end. The handle assembly further includes a body comprising a body distal end and a body proximal end, and a handle comprising a handle distal end and a handle proximal end. The brush head includes a brush head body and a plurality of bristles disposed on an outer surface of the brush head body, one or more apertures passing through the brush head body from the outer surface to the cavity, and a fastener portion. The tufts of bristles are also configured to extend in a radially-outward manner from the brush head body.

According to still another aspect of the disclosure, a method of making a toilet bowl brush assembly includes forming a head, a handle assembly, and a base. The head includes a plurality of bristles defined on an outer surface thereof, a cavity defined on an inner surface thereof, one or more apertures that pass through a thickness of the bush head, and a fastening portion. The fastening portion and the handle assembly distal end selectively couple the brush head and the handle assembly. The base includes an internal wall that defines a cup that is sized to accept the head. The base also includes one or more interference features that contact the tufts of the bristles when the brush head is in a rest position within the cup.

BRIEF DESCRIPTION OF THE SEVERAL VIEWS OF THE DRAWINGS

The following detailed description can be best understood when read in conjunction with the following drawings, where like structure is indicated with like reference numerals and in which.

DETAILED DESCRIPTION

Embodiments of the present disclosure provide a toilet bowl brush assembly that includes a sanitary way of changing and replacing at least one of a cleaner cartridge and the brush head such that touching either the cleaner cartridge or the brush head are avoided. In one embodiment, the base of the assembly has a cup for receiving the brush head, where the cup includes anti-motion features built into an inside wall of the base such that if a user can more easily separate the brush head from the brush body. For example, a user may rotate the brush body about its elongated axis while the brush head is secured in the base, and the anti-motion features may prevent the brush head from rotating relative to the base. This may in turn allow a threaded engagement that may couple the brush body to the brush head to be undone so the brush body can be removed from the brush head, thereby exposing a cavity portion that is formed within the brush head. The cavity portion can be used to accept the placement of a cleaning cartridge therein. Thus, a used brush head can be replaced or a cleaner cartridge can be refilled or otherwise placed in the cavity portion without handling the head.

Figure 1:
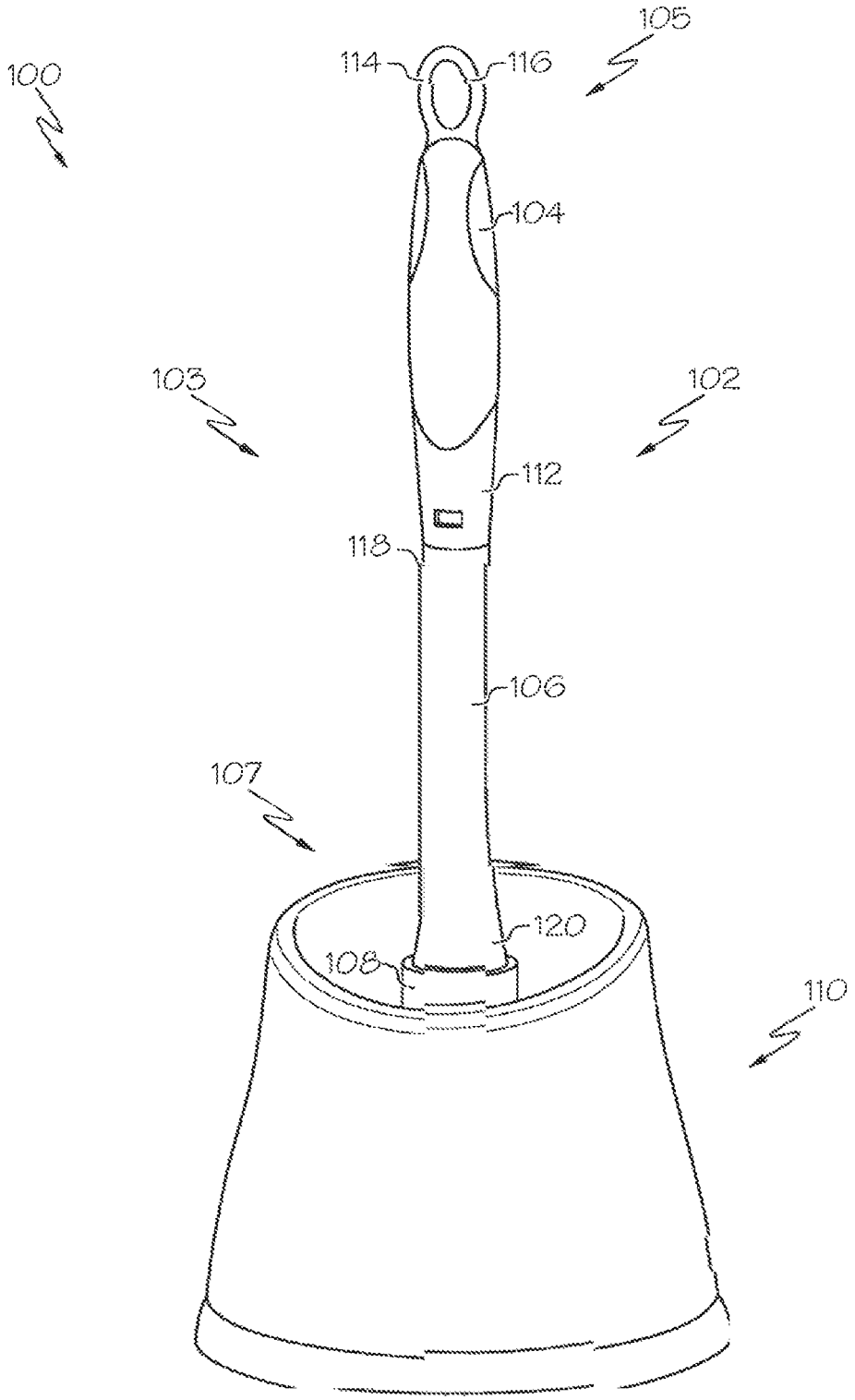
FIG. 1 shows a brush assembly with a brush including a head that is inserted in a base, according to one or more embodiments shown and described herein.
Figure 2:
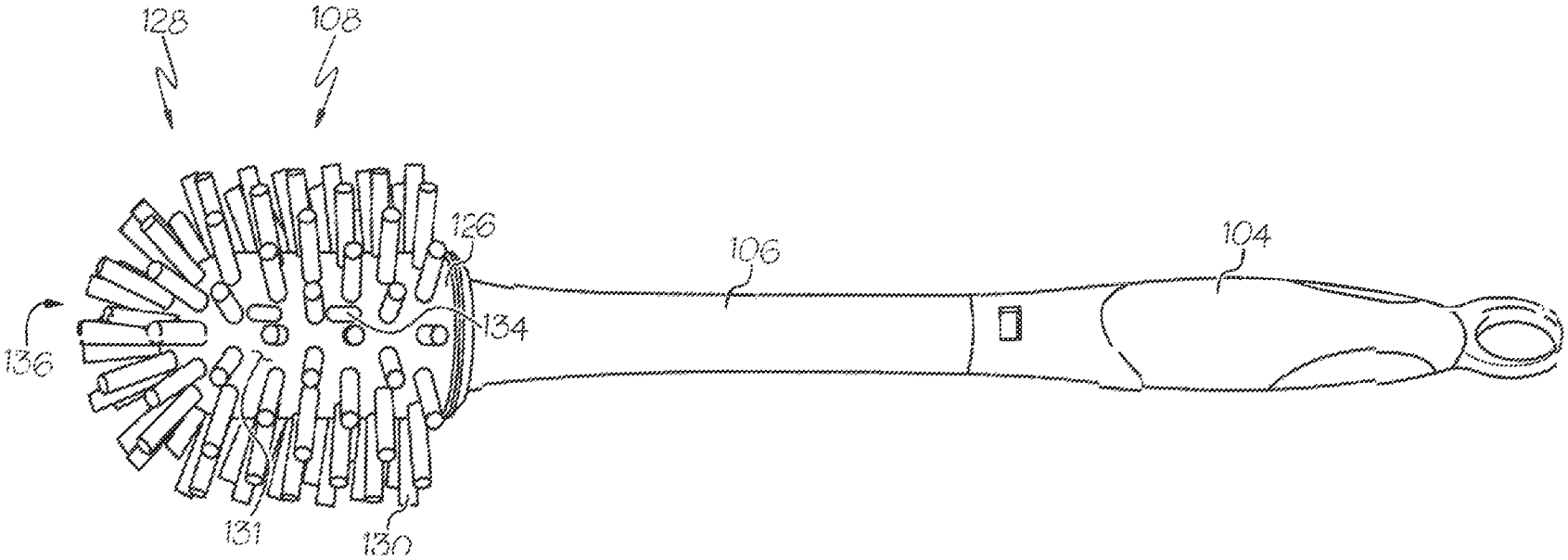
FIG. 2 shows the brush of FIG. 1 isolated from the base and including a handle, a body, and a head with a plurality of tufts of bristles schematically represented, according to one or more embodiments shown and described herein.
Figure 3:
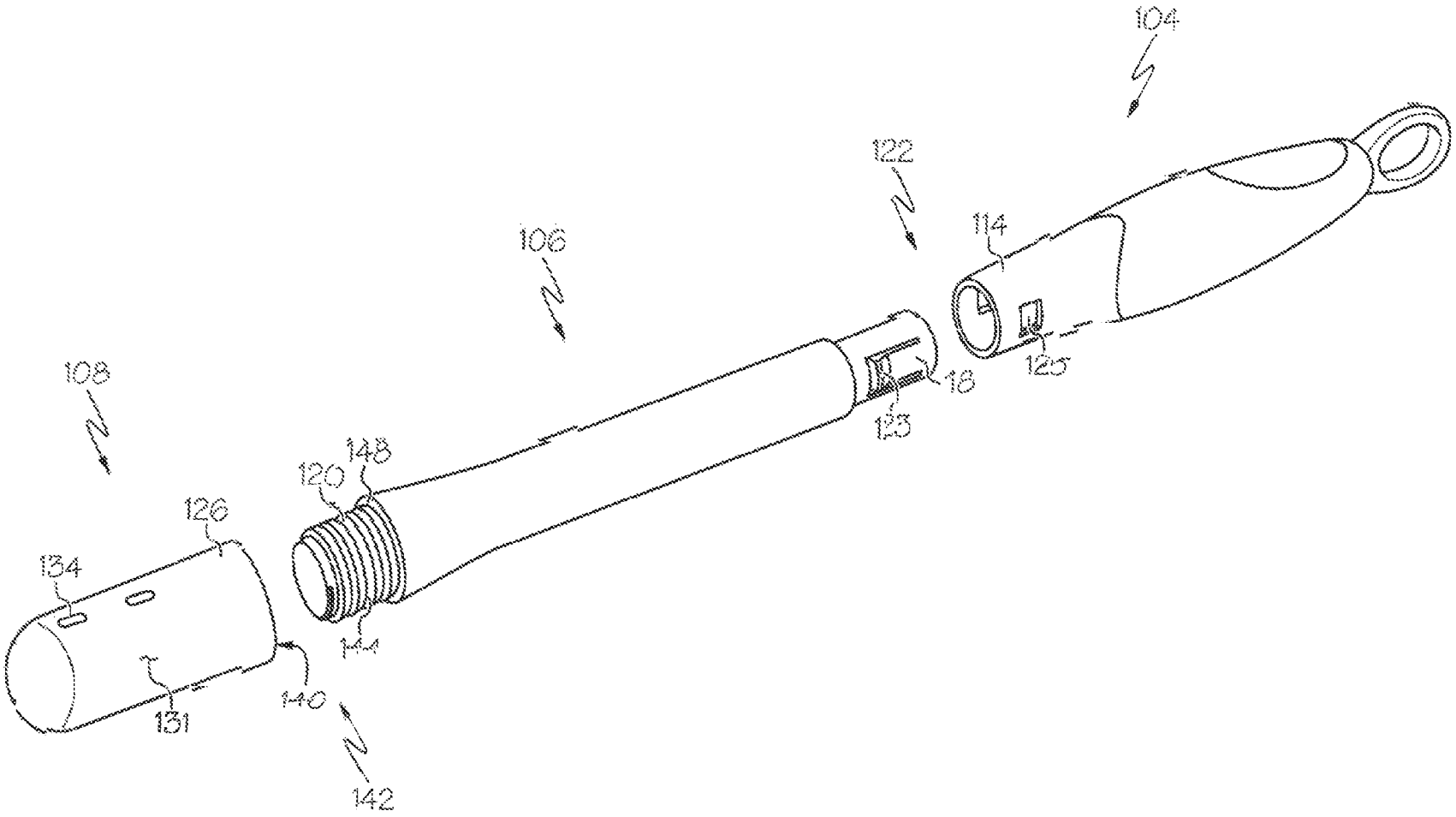
FIG. 3 shows the brush of FIGS. 1 and 2 with the handle, body, and head separated, according to one or more embodiments shown and described herein.

Referring initially to FIGS. 1, 2, and 3, the brush assembly 100 includes a brush 102 with a handle assembly 103 that includes a handle 104, a body 106, and a brush head 108 that is fit within a base 110. The brush head 108 fits within the base 110 such that the brush 102 generally stands upright due to friction between one or more components of the brush head 108 and one or more components of the base 110 during periods when the brush 102 is not in use as will be described in greater detail herein.

The handle assembly 103 comprises the handle 104 and the body 106. The handle 104 is generally situated toward a handle assembly proximal end 105 and the body 106 is generally situated toward a handle assembly distal end 107. In some embodiments, the handle 104 and the body 106 are generally selectively separable components. That is, a user of the brush assembly 100 can connect and disconnect the handle 104 and the body 106. However, embodiments are not so limited. It is contemplated that the handle assembly 103 may be a unit, such as where the handle 104 and the body 106 are generally inseparable and form a monolithic piece. The handle assembly 103 may be referred to herein as either the handle assembly 103 or as the handle 104 and the body 106 without limiting the handle assembly 103 to embodiments that are monolithic or a combination of elements or sub-elements.

In embodiments in which the handle 104 and the body 106 are separable, as shown in FIGS. 1, 2, and 3, the handle 104 may comprise a handle proximal end 112 and a handle distal end 114. The handle 104 may comprise one or more components made from a relatively soft material, for example, a thermoplastic rubber (TPR) material. The handle 104 may also comprise other materials, for example a plastic. Non-limiting examples of such a plastic include polypropylene (PP) and polyethylene (PE). The handle 104 may be ergonomically shaped to fit the hand of a user to provide a comfortable grip to the user. The handle proximal end 112 has a sufficient size to allow a user to generate sufficient torque to remove the handle 104 from the brush head 108 as will be described in greater detail herein. In some embodiments, the handle 104 includes an external attachment mechanism 116 at the handle distal end 114 for attaching the brush 102, to an external object. As shown in FIG. 2 the external attachment mechanism 116 is a ring, but embodiments are not so limited. It is contemplated that the external attachment mechanism 116 could be a hook, a snap fit mechanism, a threaded attachment mechanism, or some other type of attachment mechanism.

The body 106 comprises a body proximal end 118 and a body distal end 120. The body proximal end 118 may couple to the handle 104 and the body distal end 120 may couple to the brush head 108 as will be described in greater detail herein. The body 106 may be generally cylindrical in shape and comprise a plastic material. For example, the body 106 may comprise PP or PE. The body 106 may generally be hollow along a length of the body 106 such that the body 106 forms a void along the length of the body 106. One or more of the body proximal end 118 and the body distal end 120 may include an opening that permits access to the void. The void may be used to store one or more spare cleaning cartridges. A user may selectively remove one or more spare cleaning cartridges from the void for placement in the brush head as will be described in greater detail herein.

The handle 104 may be removably coupled to the body 106 at a handle-body connection 122, which is shown in an exploded view in FIG. 3. The handle 104 may detach from the body 106 for replacement of the handle 104, the body 106 or both.

As depicted in FIG. 3, the handle-body connection 122 is a snap-fit connection. The body proximal end 118 may include one or more moveable clips 123 and the handle distal end 114 may include one or more clip receiving portions 125. The interaction between the moveable clips 123 and the clip receiving portions 125 may prevent relative motion between the handle 104 and the body 106 while the handle 104 and the body 106 are turned relative to the base 110 to connect to the brush head 108 as will be described in greater detail herein. However, embodiments are not limited to a snap-fit connection. It is contemplated that any connection that prevents relative rotational motion between the handle 104 and the body 106 while the handle 104 and the body 106 are turned to connect to the brush head 108 may be used to connect the handle 104 and the body 106. For example, the handle-body connection 122 may comprise a snap-fit connection, a threaded attachment connection, or some other form of connection for removably coupling the handle 104 with the body 106.

In some embodiments, detachment of the handle 104 from the body 106 may expose a handle cavity 124. The handle cavity 124 may be used to store one or more reserve or additional cleaning cartridges that may be eventually be used in the brush head 108 as will be described in greater detail herein. With the handle 104 removed from the body 106, one or more additional cleaning cartridges can be placed in the handle cavity 124 for storage. When the additional cleaning cartridges are needed, the handle 104 can be removed from the body 106, and the one or more of the additional cleaning cartridges can be removed from the handle cavity 124 and placed in the brush head 108.

Figure 7:
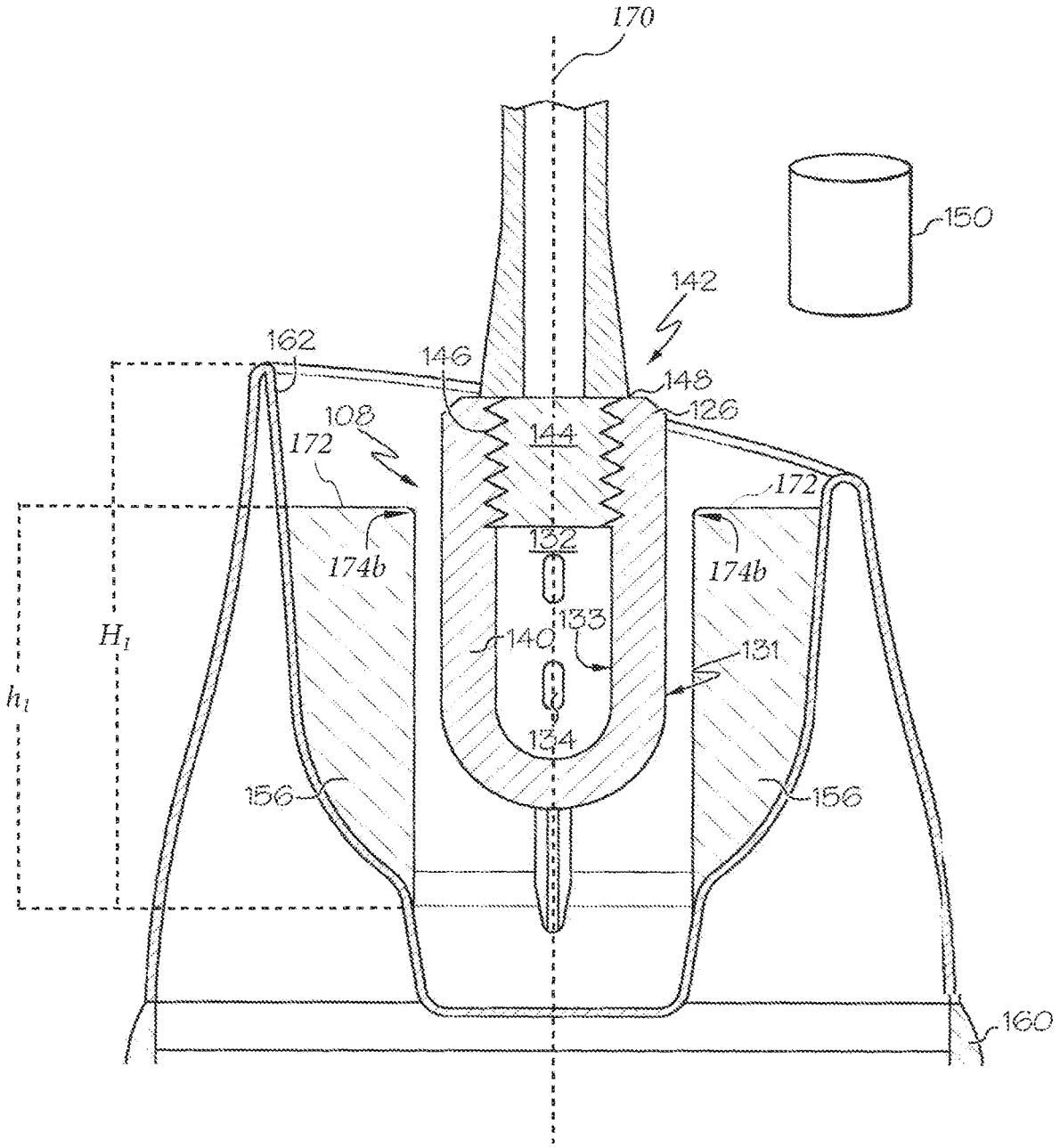
FIG. 7 shows a cross sectional view of the brush inserted in the base, according to one or more embodiments shown and described herein.

Referring specifically to FIG. 2, embodiments of the brush head 108 may include a brush head body 126 that includes a pattern 128 of tufts 130 of individual bristles on an outer surface 131 of the brush head 108. FIG. 3 shows the brush head 108 with the tufts 130 removed for illustrating the shape of one embodiment of the brush head 108. The brush head body 126 may have a generally cylindrical shape with a hemispherical distal end ("bullet" shape) and be formed from a high density plastic such as PP or PE. Referring to FIG. 7, the brush head body 126 may be hollow, including an inner surface 133 that forms a cavity 132 and a fastener portion 146 for fastening the brush head 108 to the body 106 as will be described in greater detail herein. A portion of the body distal end 120 may fit within the cavity 132 to removably couple the body 106 to the brush head 108 to hold a cleaning cartridge in the cavity 132. One or more apertures 134 may pass through a thickness 127 of the brush head body 126 from the outer surface 131 to the cavity 132 formed by the inner surface 133 to allow water to interact with the cleaning cartridge that may be in the cavity as will be described in greater detail herein.

The tufts 130 of bristles may be staple set into the brush head 108 such that they project outward in a radial direction from the elongated axis of the brush 102. The tufts 130 may be spaced such that they do not block or otherwise interfere with the flow of liquid into or out of the apertures 134. In some embodiments, the bristles may comprise a nylon fiber or some other suitable fiber or combination of fibers for making brush bristles.

Referring back to FIG. 2, the tufts 130 generally circle around the entire perimeter or circumference of the brush head body 126 to provide continuous coverage of the bristles to whatever surface the brush 102 is used to clean. The pattern 128 of tufts 130 may include a series of rows and in embodiments the number of rows may generally decrease toward a tip 136 of the brush head body 126. In some embodiments, the pattern includes seven (7) rows of twelve (12) tufts 130, one (1) row of six (6) tufts 130, and one (1) tuft 130 on the tip 136 of the brush head body 126, but embodiments may include different patterns 128 including different numbers and arrangements of tufts 130.

Referring to FIGS. 2, 3, and 7, the cavity 132 may be generally hollow and may be sized to house at least one cleaner cartridge, such as the cleaner cartridge 150, for example. One or more holes, such as apertures 134, may pass through a wall 140 of the brush head 108 that extends in thickness from the inner surface 133 to the outer surface 131 of the brush head 108. The apertures 134 may pass through the entire thickness of the wall 140 such that liquid can pass in and out of the cavity 132. The apertures 134 may be situated in between tufts 130 of bristles. In some embodiments, there are two apertures 134 on a first side of the brush head body 126 and there are two apertures 134 on a second (in some embodiments, opposite side) side of the brush head body 126. Water or other fluid may pass in or out of the cavity 132 through the apertures 134 on the first side of the brush head body 126 and may pass in or out of the apertures 134 on the second side of the brush head body 126. Some embodiments include more than four apertures 134 or apertures in an arrangement different from that shown in FIGS. 2, 3, and 7. For example, some embodiments of the brush head body 126 may include one or more apertures near the tip 136 of the brush head body 126 such that liquid does not collect in the cavity 132 when the brush 102 is placed in the base 110. Apertures near the tip 136 enable liquid to drain from a location that is nearest the bottom of the cavity 132 so that gravity naturally drains most or all of the liquid from the cavity 132 and into the base 110 as will be described in greater detail herein. The apertures 134 may be holes, portals, or equivalent structures for allowing water or other liquids to enter the cavity 132 to interact with the soap in the cleaner cartridge 150.

The particular embodiment shown in FIGS. 2, 3, and 7 shows apertures 134 that are oval in profile and have a constant perimeter through the thickness of the wall 140, but embodiments are not so limited. In some embodiments, the apertures 134 may be designed to promote liquid flow in one direction and inhibit liquid flow in another direction in order to dissolve the cleaner cartridge 150 in a particular design. For example, one or more example apertures near the tip may have a smaller profile than the apertures 134 such that they allow less fluid to flow through them than the apertures 134 shown in FIGS. 2 and 3. It may not be necessary or desirable for liquid to flow through apertures near the tip during use of the brush 102 as that could lead to uneven or accelerated dissolving of the cleaner cartridge near the tip 136 and require more frequent replacement of a cleaner cartridge. However, it may still be desirable for liquid to drain from apertures near the tip 136 in order for all or most of the liquid in the cavity 132 to drain so that little or no liquid remains in the cavity 132 when it is placed back in the base 110 and a small aperture may suffice for such drainage from the cavity 132.

As shown in FIGS. 3 and 7, the body 106 may selectively couple to the brush head 108 at a body-brush head connection 142 between the body distal end 120 and the cavity 132. In some embodiments in which the handle assembly 103 is monolithic (i.e., the handle 104 and the body 106 are unitary), the handle assembly 103 may connect to the brush head 108 at a handle assembly-brush head connection 143. The cleaner cartridge 150 may be placed inside the cavity 132 and held in place by the body distal end 120. In some embodiments, the body-brush head connection 142 is a threaded connection. For example, the body distal end 120 may include internal threading or external threading, such as threaded fastener 144, to fasten the body 106 to a fastener portion 146 of the brush head 108. In some embodiments, the fastener portion 146 of the brush head 108 comprises internal or external threading that corresponds with the threaded fastener 144 of the body 106. Embodiments of the body 106 with the body distal end 120 having internal threading will correspond to a fastener portion 146 of the brush head 108 with external threading and vice-a-versa.

While the particular embodiment shown 1, 2, 3, and 7 includes a body 106 and a brush head 108 that couple to one another using a threaded fastening mechanism, it is contemplated that the body 106 may be coupled to the brush head 108 by any other suitable means, so long as such means permits one-handed connecting and disconnecting between the two. For example, the body 106 may be coupled to the brush head 108 using a spring-loaded push button that when depressed causes a retaining mechanism to extend or retract. The spring-loaded push button and the retaining mechanism may be disposed on one or more of a body or a brush head of the alternative embodiment. In some other embodiments, a friction coupling, a clip coupling, or any other suitable means may be used to removably couple the brush head and the body.

In one some embodiments, the body 106 may include a shoulder 148. The shoulder 148 may form a peripheral ring about the body distal end 120 such that it prevents the body distal end 120 from projecting too far into the cavity 132 of the brush head 108. In some embodiments, the size of the cleaner cartridge 150 may be based at least in part on the extent to which the body distal end 120 projects into the cavity 132. For example, the body distal end 120 may hold the cleaner cartridge 150 against the inner surface 133 or a portion of the inner surface 133 of the cavity 132 such that the cleaner cartridge 150 forms a friction fit with the inner surface 133 and does not move within the cavity 132 when the cleaner cartridge 150 is placed in the cavity 132. In some embodiments, the shoulder 148 prevents the body distal end 120 from projecting too far into the cavity 132 of the brush head 108. Additionally, the shoulder 148 may form a seal between the top of the cavity 132 and the body distal end 120.

As described above, the fastener portion 146 of the brush head 108 may include external or internal threading for matching with the body distal end 120. The fastener portion 146 may be cylindrically shaped or the fastener portion 146 may be shaped corresponding to the body 106 and/or the handle 104. The fastener portion 146 may be appropriately fit to facilitate the disassembly of the body 106 from the brush head 108 in order to place the cleaner cartridge 150, which may contain soap or other surfactant, within the cavity 132.

For example, in embodiments of the brush assembly 100 utilizing a solid solvent soap, water or some other liquid may enter the cavity 132 of the brush head 108 through the apertures 134 (e.g., when the brush assembly 100 is used to clean a target surface such as a toilet bowl or other target surface in which the apertures 134 may be disposed beneath a volume of water). The cleaner cartridge 150 may be sized such that there is clearance between an external perimeter of the cleaner cartridge 150 and the inner surface 133 of the cavity 132. Thus, the liquid may react with the soap to dissolve the soap and form a soapy liquid inside the cavity 132. The soapy liquid may exit the cavity 132 through the apertures 134 as the brush is used to clean the target surface (e.g., a toilet bowl).

As the tufts 130 of bristles contact the target surface, the soapy liquid may be distributed across the target surface. In one non-limiting example, as in the toilet bowl example above, a dissolving soap capsule may be placed inside the cavity 132 of the brush head 108, and the brush assembly 100 may be placed inside the toilet bowl such that the brush head 108 is immersed in the water therein, dissolving some amount of soap such that the toilet bowl might be cleaned using that soap.

The cleaner cartridge 150 may constitute a solid or a liquid form. Embodiments of the cleaner cartridge 150 having a solid form may be a sintered or other compacted powder material. Embodiments of cleaner cartridge 150 may be composed of one or more constituents and various combinations thereof and may include ingredients such as, for example, water, a surfactant or cleaning agent such as sodium dodecylbenzene sulfonate, a carrier such as sodium sulfate, a pH adjustor such as sodium borate, one or more fragrances, one or more binders such as hydroxyethyl cellulose or a fatty alcohol, one or more dyes, and a chelator such as sodium gluconate.

Referring now to FIGS. 4-7, the base 110 for the brush assembly 100 may include a cup 154 that includes one or more interference features, a drip cup 158, and a rim 160. The one or more interference features may include at least one tab, such as for, example, the tabs 156, or other features for preventing relative motion between the base 110 and the brush head 108 as will be described in greater detail herein. For example, the interference features may include at least one anti-rotation feature. In some embodiments, the interference feature may surround an entire circumference of the cup.

The cup 154 may include an internal wall 162 that comprises a bowl shape or some other shape to contain and hold the brush head 108. The internal wall 162 of the cup 154 may form a generally concave surface inside the base 110 allowing the force of gravity and the contact with the brush head 108 to hold the brush 102 within the cup 154. The brush head 108 and the cup 154 may be sized appropriately to form a friction fit that holds the brush 102 in place such that the body 106 and the handle 104 are substantially vertical while the brush 102 is in the base 110. Thus, the handle 104 may be easier to grip in order for a user to more easily remove the brush 102 from the base 110.

Figure 4:
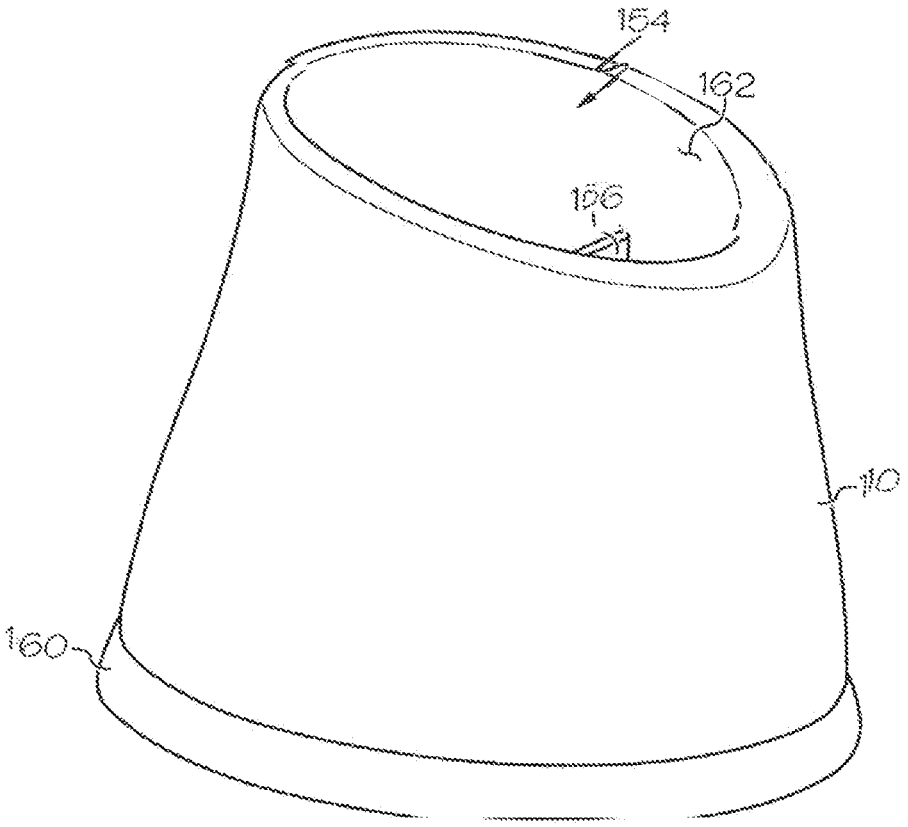
FIG. 4 shows the base of FIG. 1 in isolation, according to one or more embodiments shown and described herein.
Figure 5:
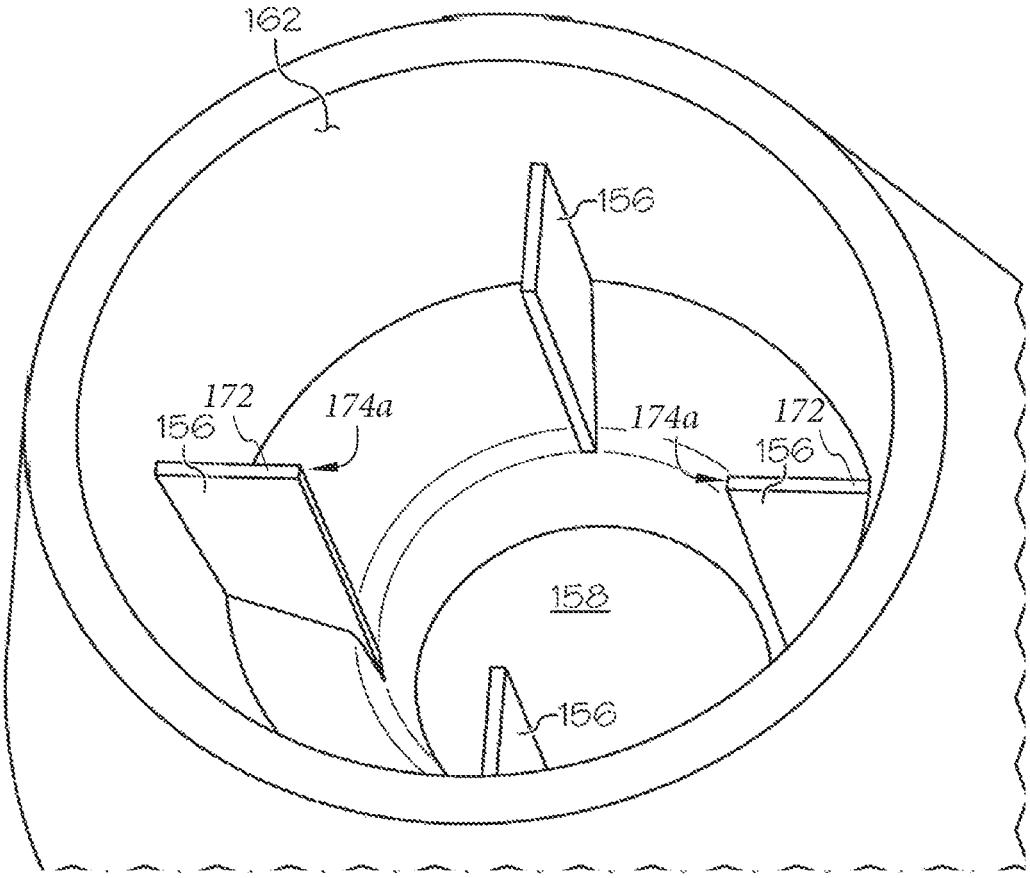
FIG. 5 shows a top view of the base of FIGS. 1 and 4, including a plurality of fins, according to one or more embodiments shown and described herein.
Figure 6:
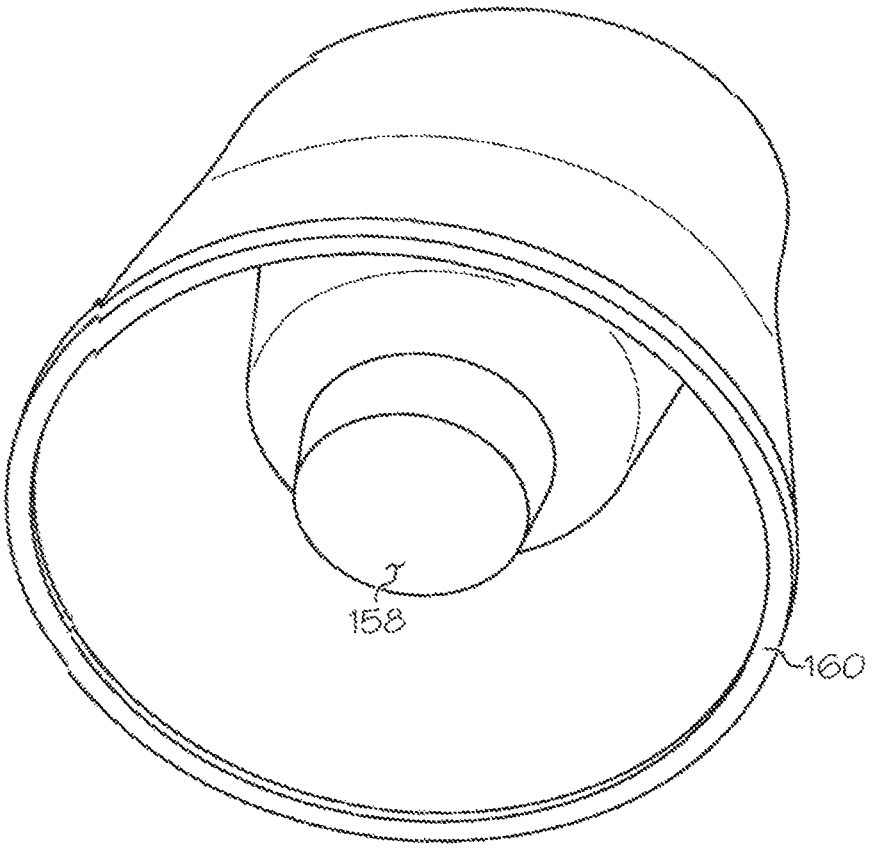
FIG. 6 shows a bottom view of the base of FIGS. 1, 4, and 5, according to one or more embodiments shown and described herein.

As shown in FIGS. 4, 5, and 7, the cup 154 may have one or more tabs 156 that extend inward towards an elongated axis 170 of the brush assembly 100 from the internal wall 162 of the cup 154 for securing the brush head 108 and for preventing free rotational motion of the brush 102 when the brush head 108 is in the cup 154. Moreover, as is clearly illustrated in FIG. 7, the one or more tabs 156 may be in the shape of an elongate rib 172. The elongate rib may also have a ledge 174, which may have a right angle edge 174*a*, as clearly illustrated in FIG. 5, or a rounded edge 174*b*, as clearly illustrated in FIG. 7. The particular embodiment shown includes four tabs 156, but embodiments are not limited to four tabs. For example, embodiments may have one or more tabs. The tabs 156 may extend from the internal wall 162 along a first plane that is parallel to the elongated axis 170 of the handle assembly 103. Moreover, as is clearly illustrated in FIG. 7, the one or more tabs 156 may continuously extend along the first plane a distance "$h_1$" that is at least a majority of the height of the cup 154 "$H_1$". In some embodiments, other anti-rotation or anti-motion features may extend from the internal wall 162 along a second plane that is perpendicular to the elongated axis of the handle assembly 103. For example, one or more auxiliary tabs may extend perpendicularly from the ends of the one or more tabs 156.

The tabs 156 may be made of relatively rigid plastic or some other material, such as PP or PE. In some embodiments, the tabs 156 may comprise the same material as the base 110. The tabs 156 are substantially solid and fixed with respect to the base 110 and may help to remove the brush head 108 from the body distal end 120. In some embodiments, the base 110, tabs 156, and the brush 102 may all be made substantially of plastic or other material having sufficient strength, such as, for example PP, PE, polyethylene terephthalate, low density polyethylene, high density polyethylene, or the like.

The base 110 may include a drip cup 158. The drip cup 158 may be a volume or space beneath the cup 154 in which the bristles do not extend. The drip cup 158 may catch excess liquid that remains on the brush head 108 and coalesces and drips into the drip cup 158 after the brush 102 has been used and returned or repositioned in the base 110. The drip cup 158 may be generally concave and molded from the same material as the base 110. In some embodiments, the drip cup 158 may include a drip cup aperture or hole that is selectively openable to drain water from the drip cup 158. For example, a hole in the bottom of the drip cup 158 that a user can use to drain water or other liquid from the drip cup as the user holds the brush assembly 100 or the base 110 over a toilet.

The base 110 may include the rim 160. The rim 160 may comprise a substance with a high coefficient of friction to prevent the base 110 from sliding while the brush assembly 100 is in use, for example, as a user is turning the handle 104 with the brush head 108 in the base 110 to remove the brush head 108 from the body 106. The rim 160 may increase the friction with the surface on which the base 110 sits (e.g., a bathroom floor or other surface) to prevent relative motion between the brush head 108 and the handle 104 or body 106 as the brush head 108 and the body 106 are fastened together or separated as discussed herein. Accordingly, the rim 160 may comprise a substance that increases the coefficient of friction between the base 110 and the surface on which the base 110 sits, for example, rubber.

In embodiments of the brush 102 having a threaded fastener connection between the body distal end 120 and the brush head 108, all that is necessary to connect or disconnect the body distal end 120 and the brush head 108 is relative motion between the body distal end 120 and the brush head 108 about a common axis of rotation. This might be accomplished by a user gripping the handle 104 and twisting the body 106 while the base 110 is held in place with the brush head 108 inserted in the base 110 such that the brush head 108 does not rotate, or vice-a-versa. In embodiments of the base 110 having tabs 156, the tabs 156 and the tufts 130 of bristles interact to prevent the rotation of the brush head 108 relative to the body 106 and the handle 104 as the handle 104 is rotated by a user. That is, the tufts 130 of bristles, which are connected to the brush head body 126, are sufficiently numerous and stiff that they prevent rotation of the brush head 108 as a user rotates the handle 104 while preventing the base 110 from rotating. That is, the radially-inward projection and the relative stiffness of the tabs 156 when mechanically combined with the sufficient number of tufts 130 of bristles having a sufficient density and stiffness prevents rotation of the brush head 108 as the handle 104 and body 106 are rotated together. In some embodiments, the friction between the threaded fasteners at the body distal end 120 and the brush head 108 is overcome as the user rotates the handle 104 and the body 106 and the body distal end 120 can be removed from the brush head 108 as the brush head 108 rests within the cup 154 of the base 110.

Once the body distal end 120 is removed, the cavity 132 is open, and a user can place the cleaner cartridge 150, other soap, or other cleaning substance within the cavity 132 of the brush head 108. As described above, the soap or related cleaning substance may be in the form of a solid cylindrical cartridge, such as cleaner cartridge 150 that is sized to slidably fit within cavity 132. The user can then replace the body distal end 120 by reinstalling the body distal end 120 within the cavity 132. The tabs 156 will prevent rotation of the brush head 108 relative to the handle 104 while the handle 104 is rotated to join the threaded fasteners of the body distal end 120 and the brush head 108. Once the brush head 108 and the body distal end 120 are connected, the user can use the brush 102 to clean.

It should now be understood that a toilet bowl brush assembly having a brush head and a removable handle assembly may be used to clean a toilet bowl. The brush head may include a pattern of tufts of bristles and one or more apertures that pass through a thickness of the brush head to a cavity. A cleaner cartridge may be placed in the cavity of the brush head. Water may pass through the apertures in the brush head, wetting the cleaner cartridge, dissolving soap or other surfactant into a soapy-water solution. The soapy-water solution may be distributed across a target surface to clean the surface.

It is noted that terms like "preferably", "generally" and "typically" are not utilized herein to limit the scope of the claims or to imply that certain features are critical, essential, or even important to the structure or function of the claims. Rather, these terms are merely intended to highlight alternative or additional features that may or may not be utilized in a particular embodiment of the present disclosure. Likewise, for the purposes of describing and defining the present disclosure, it is noted that the terms "substantially" and "approximately" and their variants are utilized herein to represent the inherent degree of uncertainty that may be attributed to any quantitative comparison, value, measurement or other representation, as well as to represent the degree by which a quantitative representation may vary without resulting in a change in the basic function of the subject matter at issue.

While certain representative embodiments and details have been shown for purposes of illustrating the present disclosure, it will be apparent to those skilled in the art that various changes may be made without departing from the scope of such disclosure, which is defined in the appended claims.

What is claimed is:

1. A toilet bowl brush assembly comprising:

a brush comprising:

a handle assembly comprising a handle assembly proximal end and a handle assembly distal end and having an elongated axis extending from the proximal end to the distal end; and a brush head that comprises a plurality of tufts of bristles disposed on an outer surface of the brush head, a cavity defined by an inner surface of the brush head, and a fastener portion;

a base comprising a cup for receiving the brush head; and wherein the cup has an internal wall defining an interference feature comprising a plurality of tabs projecting inward from the internal wall of the cup and not surrounding the entire circumference of the cup, each of the plurality of tabs is an elongate rib that extends along a first plane that is parallel to the elongated axis of the handle assembly, the brush head selectively couples to the handle assembly distal end at the fastener portion of the brush head at a handle assembly-brush head connection, and the plurality of tabs contact the tufts of bristles when the brush head is in a rest position within the cup.

2. The toilet bowl brush assembly of claim 1, wherein the brush head defines at least one aperture formed through a thickness of the brush head.

3. The toilet bowl brush assembly of claim 2, wherein:

the cavity is sized to receive at least one cleaner cartridge, and the cavity is opened by removing the handle assembly from the brush head to enable insertion of the at least one cleaner cartridge.

4. The toilet bowl brush assembly of claim 3, wherein with the at least one cleaner cartridge inserted in the cavity, there is sufficient space between the inner surface of the brush head and the at least one cleaner cartridge such that a liquid flowing through the one or more apertures can completely surround the at least one cleaner cartridge.

5. The toilet bowl brush assembly of claim 1, wherein the handle assembly-brush head connection is a threaded fastener connection.

6. The toilet bowl brush assembly of claim 1, wherein the handle assembly-brush head connection is a spring-loaded push button fastener connection.

7. The toilet bowl brush assembly of claim 1, wherein the handle assembly-brush head connection is a friction coupling fastener connection.

8. The toilet bowl brush assembly of claim 1, wherein at least two of the plurality of tabs are perpendicular to each other.

9. The toilet bowl brush assembly of claim 1, wherein the at least one interference feature comprises four of the tabs and the four tabs are equally spaced around a circumference of the cup.

10. The toilet bowl brush assembly of claim 1, wherein the cup further comprises a drip cup beneath the cup for receiving excess liquid from the brush head.

11. The toilet bowl brush assembly of claim 1, wherein the elongate rib continuously extends along the first plane a majority of the height of the cup.

12. The toilet bowl brush assembly of claim 1, wherein the elongate rib defines a ledge.

13. The toilet brush assembly of claim 12, wherein:

the ledge of the elongate rib is rounded; or the ledge of the elongate rib is at a right angle.

14. A method of manufacturing a toilet bowl brush assembly comprising:

forming a brush head comprising a plurality of tufts of bristles defined on an outer surface thereof, a cavity defined on an inner surface thereof, one or more apertures that pass through a thickness of the brush head, and a fastening portion;

forming a handle assembly having a handle assembly proximal end a handle assembly distal end, and an elongated axis extending from the proximal end to the distal end;

forming a base comprising a cup that is sized to accept the brush head; and wherein the cup has an internal wall defining an interference feature comprising a plurality of tabs projecting inward from the internal wall of the cup and not surrounding the entire circumference of the cup, each of the plurality of tabs is an elongate rib that extends along a first plane that is parallel to the elongated axis of the handle assembly, the plurality of tabs contact the tufts of bristles when the brush head is in a rest position within the cup, and the fastening portion and the handle assembly distal end selectively couple the brush head and the handle assembly.

15. The method of manufacturing a toilet bowl brush assembly of claim 14, wherein the elongate rib continuously extends along the first plane a majority of the height of the cup.

16. The method of manufacturing a toilet bowl brush assembly of claim 14, wherein the elongate rib defines a ledge.

17. The method of manufacturing a toilet bowl brush assembly of claim 16, wherein:

the ledge of the elongate rib is rounded; or the ledge of the elongate rib is at a right angle.

* * * * *